US008413637B2

(12) United States Patent
Schnell

(10) Patent No.: US 8,413,637 B2
(45) Date of Patent: Apr. 9, 2013

(54) INJECTION NOZZLE FOR FUEL WITH BALL VALVE

(75) Inventor: Matthias Schnell, Schorndorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/744,819

(22) PCT Filed: Oct. 31, 2008

(86) PCT No.: PCT/EP2008/064831

§ 371 (c)(1),
(2), (4) Date: May 26, 2010

(87) PCT Pub. No.: WO2009/068414

PCT Pub. Date: Jun. 4, 2009

(65) Prior Publication Data

US 2010/0313852 A1 Dec. 16, 2010

(30) Foreign Application Priority Data

Nov. 26, 2007 (DE) ..... 10 2007 056 913

(51) Int. Cl.
*F02M 51/00* (2006.01)
*F02M 51/06* (2006.01)

(52) U.S. Cl. ..... 123/472; 123/490

(58) Field of Classification Search ..... 123/467, 123/468, 469, 472, 490, 499; 239/585.5, 239/585.1, 585.4, 585.8, 88, 96, 124; 251/129.15, 251/129.16

See application file for complete search history.

(56) References Cited

U.S. PATENT DOCUMENTS

| | | | | |
|---|---|---|---|---|
| 5,820,033 | A | 10/1998 | Cooke | |
| 5,820,101 | A * | 10/1998 | Ricco | 251/129.16 |
| 5,890,653 | A * | 4/1999 | Kelly | 239/5 |
| 5,901,941 | A | 5/1999 | Ricco | |
| 5,984,264 | A * | 11/1999 | Ricco | 251/129.16 |
| 6,199,774 | B1 * | 3/2001 | Ricco | 239/533.8 |
| 6,764,061 | B2 * | 7/2004 | Haeberer et al. | 251/129.16 |
| 2008/0296413 | A1 | 12/2008 | Ganser | |

FOREIGN PATENT DOCUMENTS

| | | | |
|---|---|---|---|
| EP | 1319827 | A2 | 6/2003 |
| JP | 2003193939 | A | 7/2003 |
| JP | 2005016528 | | 1/2005 |
| WO | 2007009279 | A1 | 1/2007 |

* cited by examiner

*Primary Examiner* — Mahmoud Gimie
(74) *Attorney, Agent, or Firm* — Michael Best & Friedrich LLP

(57) ABSTRACT

The invention relates to a fuel injector comprising a nozzle retainer or an injector body, a valve body and a nozzle body, in which a preferably needle-shaped injection valve member is arranged to be vertically movable, said member releasing or closing at least one injection port leading to a combustion chamber of an internal combustion engine depending on the pressure relief of or the pressure load on a control chamber. The invention is characterized in that a valve comprising a preferably ball-shaped valve element is arranged in the nozzle retainer or in the injector body for the pressure relief of the control chamber.

3 Claims, 5 Drawing Sheets

INJECTION NOZZLE FOR FUEL WITH BALL VALVE

CROSS-REFERENCE TO RELATED APPLICATION

This application is a 35 USC 371 application of PCT/EP2008/064831 filed on Oct. 31, 2008.

BACKGROUND OF THE INVENTION

1. Field of the Invention

In modern internal combustion engines, in particular Diesel engines, injection systems are used in which a high-pressure pump puts the fuel at a high pressure level. The fuel acts on a high-pressure reservoir body (common rail), which when the engine is in operation is constantly under pressure or in other words is subjected to a system pressure level generated by the high-pressure pump. High-pressure lines that ensure the supply of fuel to the engine cylinders branch off from the high-pressure reservoir body. Via fuel injectors, the fuel that is delivered via the high-pressure lines is injected into the combustion chamber of the cylinders of the engine.

2. Description of the Prior Art

In common rail injection systems, the injection event into the combustion chambers of the engine is uncoupled from the pressure generation in the high-pressure reservoir body (common rail). As a result, the instant and quantity of fuel injection can be controlled by engine electronics. This makes an injection adapted to the particular engine load possible. In typical applications, a system pressure of at least 1800 bar is generated in the high-pressure reservoir body (common rail); even high pressures above 2000 bar can be generated. By means of common rail injection systems, a plurality of injections per work cycle can be achieved. Typically, this results in a preinjection, a main injection, and a postinjection.

The control of the injection event is effected with the aid of an electrical signal, which is generated by the control unit of the engine. The electrical signal serves to trigger a solenoid valve for actuating the fuel injector. This solenoid valve, via suitable hydraulics, regulates the motion of a preferably needle-shaped injection valve member, which with its tip opens or closes at least one injection opening into the combustion chamber of the engine. The injection event is initiated by actuation of the solenoid valve, as a result of which a fuel-filled control chamber is pressure-relieved by actuation of the preferably needle-shaped injection valve member. Because of the pressure relief of the control chamber, the preferably needle-shaped injection valve member moves upward, and as a result, at the tip of the injection valve member, injection openings embodied in the nozzle body are opened.

In the prior art, the solenoid valve exists in many different structural forms, as for example in German Patent Disclosure DE 196 50 865 A1. In a variant, a spherically embodied valve element is used, which is disposed at the upper end of the fuel injector and can be moved longitudinally of the fuel injector axis, which coincides with the axis of the injection valve member. In the closed state, the spherically embodied valve element seals off a conically polished valve seat.

As a further variant, the solenoid valve can also be placed in the lower region of the fuel injector, particularly in the injector body of the fuel injector. European Patent Disclosure EP 0 740 068 B1 discloses one such variant of a fuel injector. A valve member there is guided in a valve body, which is sealed off from the fuel that is at high pressure. In this way it is ensured that the fuel at high pressure does not exert any forces on the valve member. Typically, the axis of motion of the valve member, in such a variant, is offset laterally from the axis of motion of the injection valve member. Such a fuel injector is substantially more expensive to produce than a fuel injector provided with a spherically embodied valve member.

SUMMARY OF THE INVENTION

The present invention realizes a fuel injector with a valve that has a spherically embodied valve element, and this valve is placed directly in the injector body of the fuel injector. The valve is sturdy and has withstood the test of time. In a preferred feature of the present invention, the valve makes do without guidance of an armature or a pressure equilibrium. Thus this valve is very inexpensive.

The valve with the spherically embodied valve element is prestressed by a valve spring and is pressed into a closing position. When current is supplied to a magnet, an armature unit is attracted, counter to the action of the valve spring, and opens an outlet conduit from the control chamber. A control quantity flows out from this chamber, so that the preferably needle-shaped injection valve member moves into the control chamber and opens at least one injection opening on the end of the fuel injector toward the combustion chamber, so that fuel can be injected into the combustion chamber of the engine.

In the state of repose, the valve spring, via the armature, presses the spherically embodied valve element into a valve seat, which for example is embodied conically. In this state, the valve seat is sealed off by the closing force acting in the vertical direction as a result of the valve spring. The force exerted by the valve spring, in the state of repose, exceeds a contrary force generated by the system pressure in the control chamber.

The control chamber communicates with a high-pressure line via a first throttle restriction (inlet throttle restriction) and with the valve seat of the spherically embodied valve element via a second throttle restriction (outlet throttle restriction). The upper end of the preferably needle-shaped injection valve member protrudes into this control chamber. The preferably needle-shaped injection valve member is disposed vertically movably along a second axis, and this second axis extends parallel to the first axis of the valve spring. In the state of repose, fuel at system pressure is located in the control chamber and is delivered from the high-pressure line via the inlet throttle restriction. The force exerted by the fuel at system pressure on the preferably needle-shaped injection valve member ensures that the preferably needle-shaped injection valve member is not moved all the way into the control chamber. In this state, the preferably needle-shaped injection valve member closes at least one injection opening located at its tip. The fuel delivered to this injection opening via the high-pressure line can accordingly not be injected into the combustion chamber of the engine.

In an embodiment of the present invention, the armature unit, in particular the armature plate, is joined together from one inner component and one outer component. The inner part and the outer part are made from two different materials, and the material for the outer part is selected in accordance with magnetic properties. The material for the inner part of the armature unit is selected in accordance with mechanical requirements in view of hardness and machinability in the vicinity of the valve element as well as with regard to the mechanical requirements of the stroke stop. The two parts of the armature may be joined to one another positively or non-positively. The armature is not guided in the valve body of the valve; instead, the position of the armature in the closed state of the valve results from the fact that the spherically embodied valve element is aligned with the valve seat, and the armature in turn is aligned with the spherically embodied valve element. In a variant embodiment, the armature may also be embodied of a single material as a one-piece component. It is equally well possible to provide a closing element receptacle, for the closing element that for example can be embodied spherically, on the armature unit. As a result, a greater axial offset of the armature unit relative to the valve seat can be compensated for. This variant, that is, the use of a closing element guide, can be combined with the armature that can be embodied as either in one piece or, as sketched above, in two parts. The armature is guided in the magnet core of the valve with a slight radial play, so that a virtually perpendicular orientation of the armature plate relative to the face end of the magnet is ensured.

In further variant embodiments what is proposed according to the invention, the possibility exists of locating the valve seat in the interface plane between the injector body and the valve body. This disposition of the valve seat has advantages upon assembly of the fuel injector. In one embodiment, the solenoid valve assembly can be aligned via a spacer sleeve on the valve body or can be surrounded in a sleeve (cartridge) that receives the entire electromagnet valve assembly. The electromagnet and the sleeve can be joined together nonpositively or positively and are disposed as a preassembled unit in the injector body of the fuel injector proposed according to the invention.

BRIEF DESCRIPTION OF THE DRAWINGS

Exemplary embodiments of the invention are described in further detail in the ensuing description in conjunction with the drawings, in which.

Exemplary embodiments of the invention are described in further detail in the ensuing description.

DESCRIPTION OF THE PREFERRED EMBODIMENTS

Figure 1:
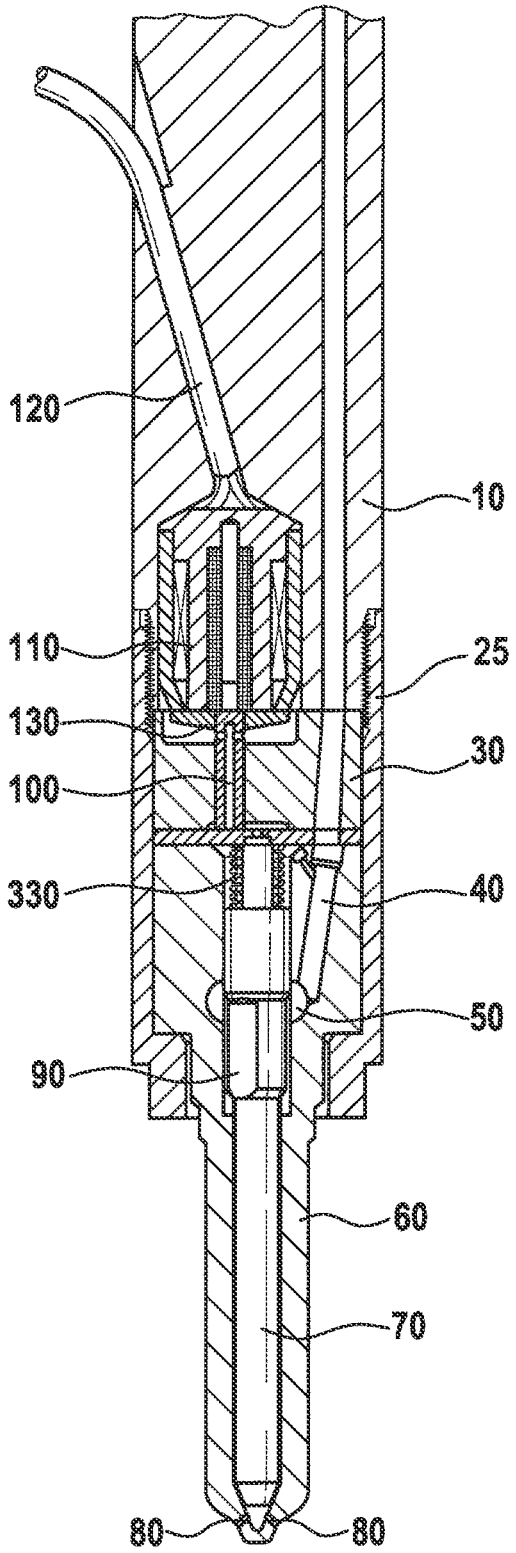
FIG. 1 shows a fuel injector corresponding to the prior art, with a conventional injection valve member.

In FIG. 1, a fuel injector corresponding to the prior art is shown, which has a conventional valve needle.

An injector body or "nozzle holder" 10 includes a high-pressure line 40, which is filled with fuel, for instance Diesel fuel. The nozzle holder 10 further includes a magnet 110, which is controlled via an electrical connection 120. The magnet 110 is connected to a valve seat 130 and an injection valve member 100. If an electric current is flowing through the magnet 110, then the injection valve member 100 moves along a first axis and uncovers the communication with a control chamber 330. In this way, the fuel located in the control chamber 330 can flow out through the valve 100 and a suitable connection. As a consequence of the fuel outflow from the control chamber 330, the pressure in the control chamber 330 decreases.

In the lower part of the fuel injector there is a nozzle body 60, which includes a preferably needle-shaped injection valve member 70 to which fuel is delivered via the high-pressure line 40. To that end, there is a nozzle chamber 50, which is filled with fuel, in the nozzle body 60. A hollowed-out area 90 in the body of the injection valve member 70 is located in the vicinity of the nozzle chamber 50 and leads to a vertical reciprocating motion of the injection valve member along a second axis, which as a rule is disposed vertically, if the hydraulic force relationships vary. The hollowed-out area 90 serves to conduct fuel from the nozzle chamber 50 between the needle-shaped injection valve member 70 and the nozzle body 60. The preferably needle-shaped injection valve member 70 continues to be closely guided in the nozzle body 60 in the vicinity of the hollowed-out area 90.

The injection event is tripped in that the engine control unit, via the electrical connection 120, sends a current through the magnet 110, so that the valve member 100 opens up the communication with the control chamber 330 and thus reduces the hydraulic pressure in the control chamber 330. In this way, the injection valve member 70 moves into the control chamber 330 and uncovers at least one injection opening 80 on the end toward the combustion chamber of the fuel injector, as a result of which fuel emerges from the at least one injection opening 80 and, in the event of sufficiently high pressure in the cylinder, is atomized. A clamping nut 25 ensures a positive fixation of the fuel injector on the cylinder head of the internal combustion engine.

Figure 2:
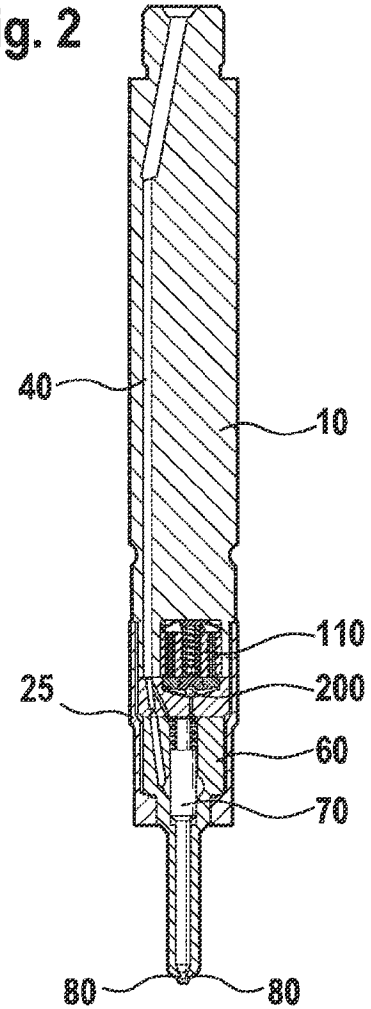
FIG. 2 shows an embodiment according to the invention of the fuel injector, with a valve that has a spherically embodied valve element.

In FIG. 2, the fuel injector of the invention is shown, with a valve including a spherical closing element 200, which is used instead of the valve member 100 of FIG. 1 that is used in the prior art.

The injection of the fuel, which is at system pressure, via a high-pressure line 40 is effected, as in the prior art, as a function of the position of a preferably needle-shaped injection valve member 70. Analogously to the prior art, the injection event is initiated by feeding an electric current into a magnet 110. In the fuel injector of the invention, the valve including the spherically embodied valve element 200 and the magnet 110 is seated inside the injector body 10. Conversely, the valves used in the prior art are used only in the upper part of an injector body of the fuel injector, typically above a nozzle body.

Figure 3:
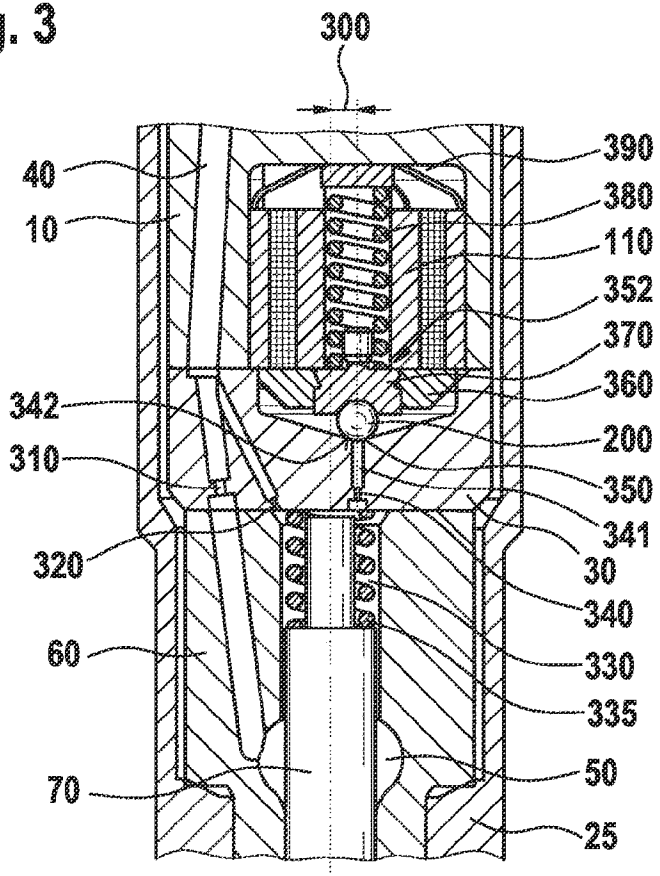
FIG. 3 shows an enlarged detail of FIG. 2.

In FIG. 3, an enlarged detail of the lower portion of the fuel injector of FIG. 2 is shown.

Via the high-pressure line 40, the fuel at system pressure is delivered. The high-pressure line 40 extends with a lateral offset from the axis of the nozzle holder 10 and extends through the valve body 30. In the valve body 30, the high-pressure line 40 forks. A first portion of the high-pressure line 40 extends through a cross-sectional constriction 310, which is called a D throttle restriction and has a pressure-reducing effect. If the preferably needle-shaped injection valve member 70 is open and for terminating the injection the valve is closed, and the control chamber 330 is subjected to system pressure, then system pressure also prevails below the needle-like injection valve member 70. The needle-like injection valve member 70 would for that reason, because of the action of a nozzle spring 335, close very slowly. The cross-sectional constriction 310 called a D throttle restriction reduces the pressure below the needle-like injection valve member 70, so that a greater hydraulic force is created, which markedly accelerates the closure of the preferably needle-shaped injection valve member 70.

A further segment of the high-pressure line 40 extends on the other side of the cross-sectional constriction 310 and discharges into the nozzle chamber 50. The shape, size and position of the nozzle chamber 50 can vary depending on the application; typically, the nozzle chamber 50 is disposed in the upper part of the nozzle body 60 as in FIG. 2 and forms a closed ring around the injection valve member 70.

A second line segment, branching off from the high-pressure line 40 after it forks, extends through an inlet throttle restriction 320, which discharges into a control chamber 330. The preferably needle-shaped injection valve member 70 protrudes with its upper end partway into the control chamber 330, in the state of repose. The control chamber 330 also receives fuel that in the state of repose is at system pressure. The pressure of the fuel in the control chamber 330 compensates for the pressure generated by the fuel in the nozzle chamber 50, so that the preferably needle-shaped injection valve member 70 in FIG. 2 seals off the at least one injection opening 80 in FIG. 2. In this way, in the state of repose, no fuel can emerge from the at least one injection opening 80 and reach the combustion chamber of the cylinder.

Communicating with the control chamber 330 is an outlet throttle restriction 340, which is provided in an outlet conduit 341 that discharges at an orifice 350 below the valve seat 342. The spherically embodied valve element 200 and the orifice 350 form the valve seat 342. The orifice 350 in this application is designed conically, so that a closing element 200 that is embodied spherically for instance and is seated in the orifice 350 seals off this orifice completely. In this way, in the position of repose, no fuel can emerge from the orifice 350 of the outlet conduit 341.

In a preferred feature of the present invention shown in FIG. 3, above the spherical valve element 200 is an armature unit 352 with an inner armature part 370 which in the outset state as a result of the position of the spherically embodied valve element 200 is aligned relative to the valve seat 342. An outer armature part 360 of the armature unit 352 laterally defines the inner armature part 370 and is joined, for instance by positive engagement, to the inner armature part 370. In a preferred feature of the present invention, the armature unit 352 formed of the inner armature part 370 and the outer armature part 360 requires no guidance in the nozzle body 60. Hence this valve is economical.

In the state of repose, a valve spring 380 exerts a closing force on the inner armature part 370 of the armature unit 352 and on the spherically embodied valve element 200, along a first axis of motion. By means of this force, the spherically embodied valve element 200 is press-fitted with the aid of the inner armature part 370 into the valve opening 350. The magnet 110, pressed in the direction of the orifice 350 via a prestressing element 390, is activated at the onset of the injection event by an electric current. As a result, the armature unit 352 is attracted, counter to the action of the valve spring 380 that acts in the closing direction. The orifice 350 of the outlet conduit 341 opens, and the control chamber 330 is pressure-relieved as a result of diversion of a control quantity.

By means of the orifice 350 opened during the injection event, the fuel can now escape from the control chamber 330, so that the pressure in the control chamber 330 drops. Because of the lesser pressure in the control chamber 330, the preferably needle-shaped injection valve member 70 moves into the control chamber 330. In the process, the injection valve member 70 executes a motion along a second axis, which extends offset from and parallel to the first axis of the valve spring 380. As a result of this motion of the preferably needle-shaped injection valve member 70, the injection valve member 70 on its lower end uncovers the at least one injection opening 80 and enables the injection of fuel into the combustion chamber of the engine.

It can be seen from the view in FIG. 3 that the armature unit 352 is constructed in two parts and includes an outer armature part 360 and an inner armature part 370. In the variant embodiment shown in FIG. 3, the outer armature part 360 and the inner armature part 370 are made from two different materials. The material from which the outer armature part 360 is made can be selected for its magnetic properties. The material from which the inner armature part 370 of the armature unit 352 is made is selected to take mechanical requirements into account. With regard to the mechanical requirements, the hardness and machinability in the vicinity of the spherically embodied valve element 200 can be named, as well as the hardness with which stroke stops should be embodied. The two armature parts 360 and 370 of the armature unit 352 can be joined together by positive or nonpositive engagement. The armature unit 352 in the embodiment in FIG. 3 has no guide in the valve body of the valve; in the closed state or in other words the state of repose of the fuel injector, the position of the armature unit 352 is due to the fact that the preferably spherically embodied closing element 200 is aligned with the valve seat 342 of the valve body 30, and the armature unit 352 is in turn aligned with what here is the spherically embodied valve element 200.

Figure 4:
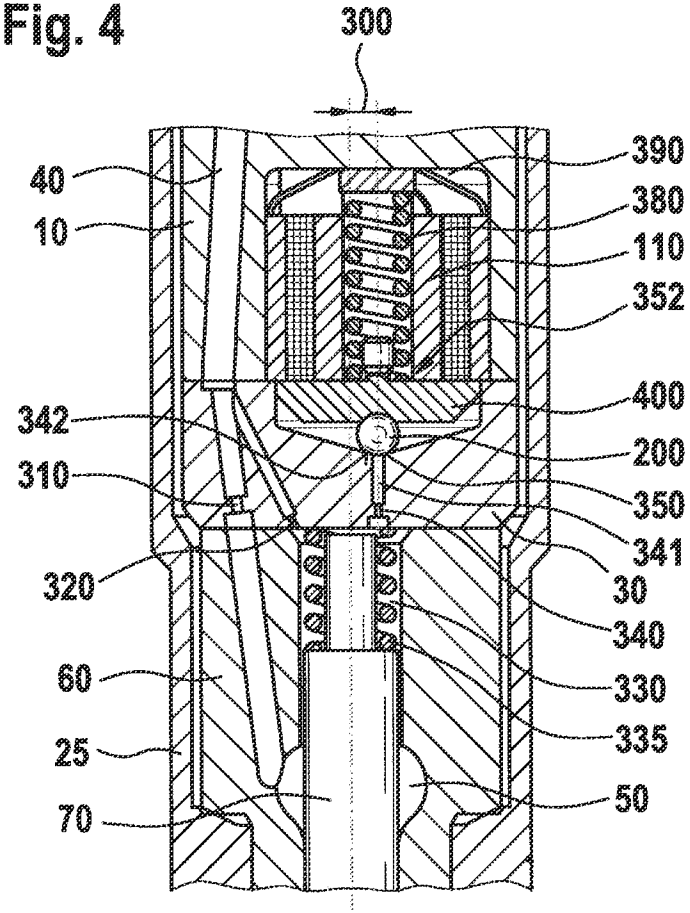
FIG. 4 shows a variant of the fuel injector, with a valve that is actuated via a one-piece armature.

In a further variant of the fuel injector of the invention, instead of a two-piece armature unit 352, including an inner armature part 370 and the outer armature part 360 in FIG. 3, a one-piece armature 400 is used. FIG. 4 shows the one-piece armature 400 in an enlarged detail of the fuel injector of FIG. 2. In addition to the one-piece armature 400, in a further feature of the present invention a guide 500 is employed, which allows an axial offset of the armature unit 352 relative to the valve seat 342 of the valve. The provision of the guide 500 can be combined with either a one-piece armature 400, as shown in FIG. 4, or a two-piece armature unit 352 as shown in FIG. 3.

Figure 5:
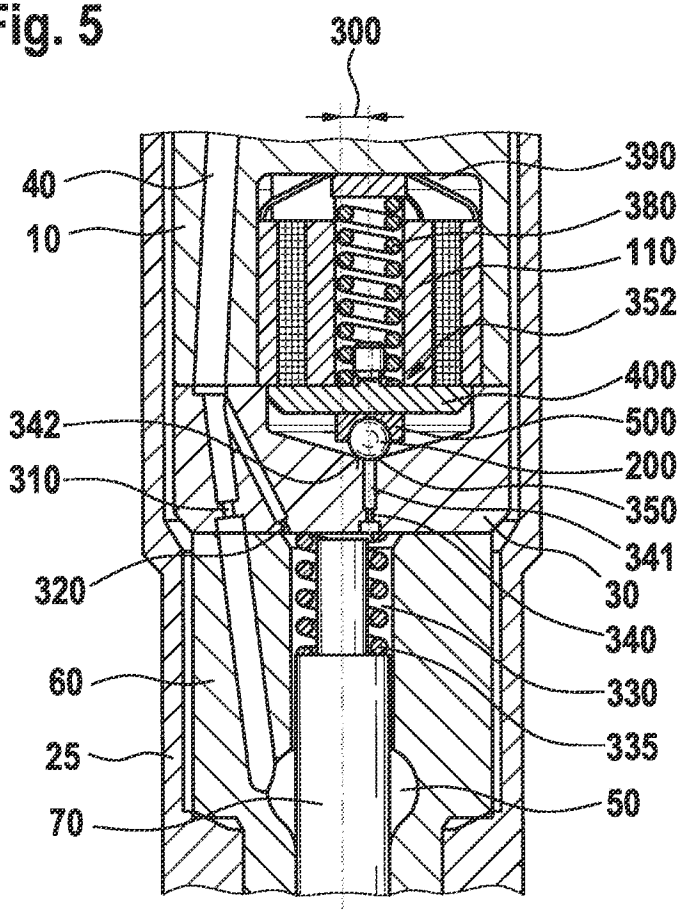
FIG. 5 shows a variant of the fuel injector of the invention, with a valve which in addition to the one-piece armature has a closing element guide.

FIG. 5, in an enlarged detail of FIG. 2, shows the armature 400 in combination with the guide 500. Alternatively, instead of the one-piece armature 400, a two-piece armature can be used, including the inner armature part 370 and the outer armature part 360 as shown in FIG. 3.

Figure 6:
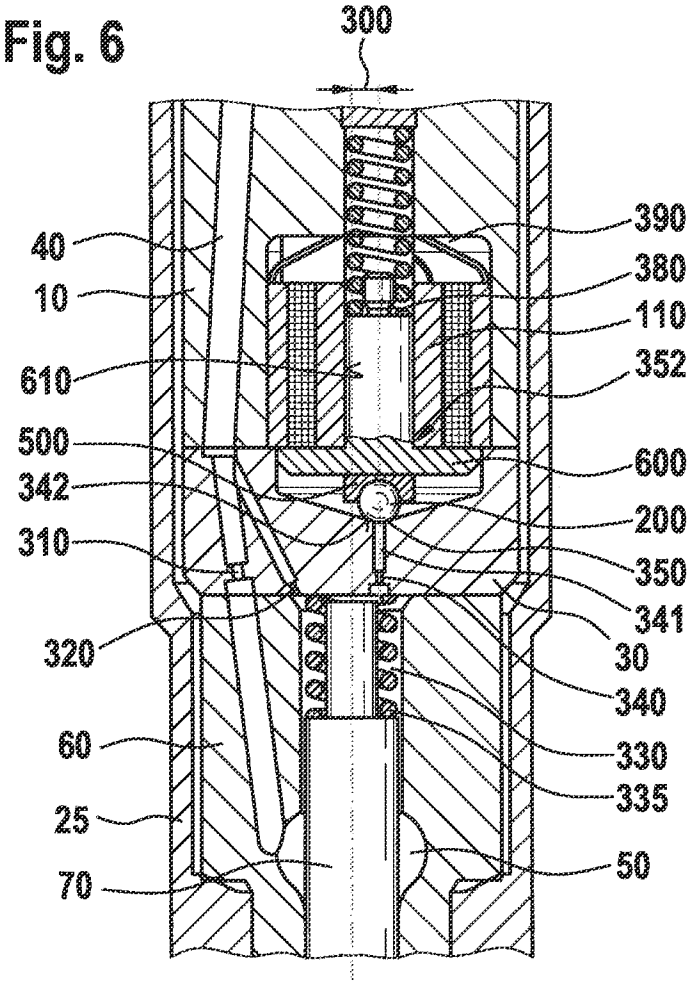
FIG. 6 shows a variant of the fuel injector of the invention, having a valve that is actuated by an armature running in a guide.

In a further variant of the present invention, shown in FIG. 6 as a detail of FIG. 2, a guided armature 600 is used. For that purpose, part of the guided armature 600 is guided into a bore 610 in the magnet 110; the upper end of the guided armature 600 is designed cylindrically, so that the guided armature 600 is inserted by positive engagement and yet nevertheless movably into the bore 610 of the magnet 110. In this way, with minimized radial play, an optimal perpendicular alignment of the guided armature 600 relative to the magnet 110 is attained.

Figure 7:
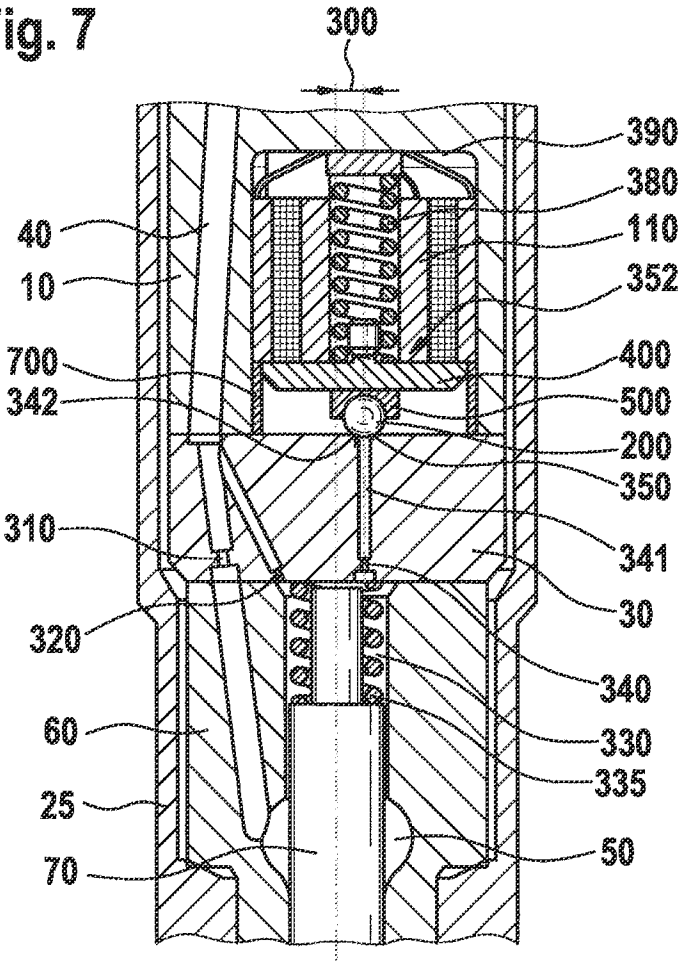
FIG. 7 shows a variant of the fuel injector of the invention, having a valve that is fixed via an armature that is aligned via spacer sleeves in the valve body.

In FIG. 7, a variant of the present invention is shown in which the one-piece armature 400 is aligned with the valve body 60 via at least one spacer sleeve 700.

Figure 8:
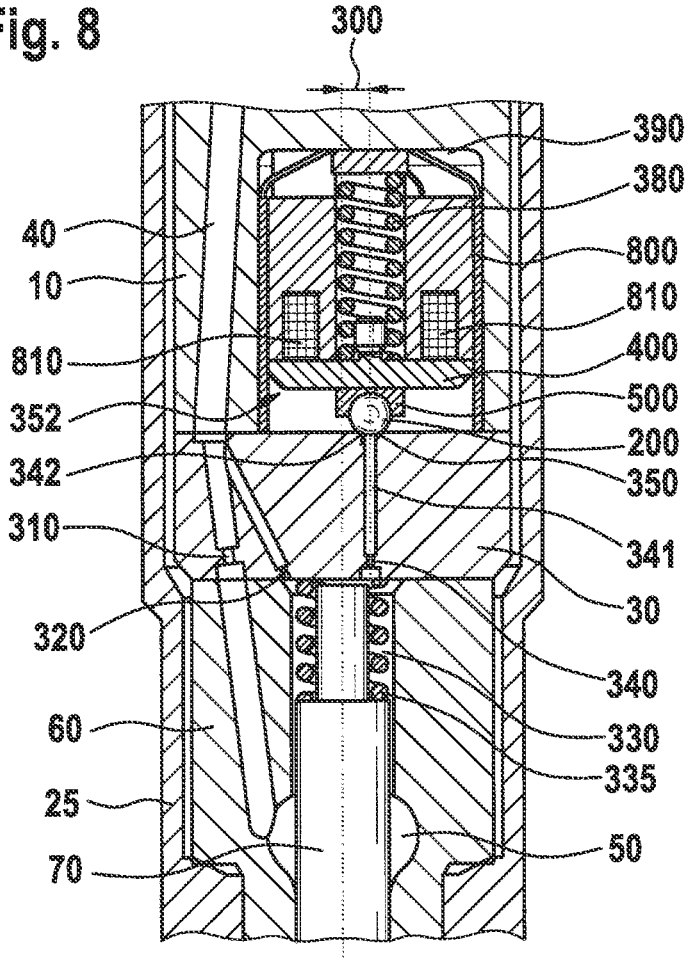
FIG. 8 shows a variant of the fuel injector of the invention, having a valve that includes an electromagnet and a magnet sleeve joined to the electromagnet positively and nonpositively.

In FIG. 8, a variant of the invention can be seen in which a magnet in cartridge form 810 is used, which is connected by nonpositive or positive engagement to a magnet sleeve 800 and thus installed as a unit in the nozzle body 60.

In the variant embodiments shown in FIGS. 7 and 8 of the fuel injector proposed according to the invention, the valve seat 342 is shifted into the plane of the interface between the injector body 10 and the upper flat side of the valve body 30. This has advantages for example in the assembly of the fuel injector. While in the embodiment shown in FIG. 7 the electromagnet 110 is aligned with the valve body 30 via a spacer sleeve 700, in the embodiment of FIG. 8 the electromagnet 110 is built in, packaged as a "cartridge", into the injector body 10. In both versions in FIGS. 7 and 8, the magnet 110 can be joined by nonpositive and positive engagement to the spacer sleeve 700 surrounding it or the magnet sleeve 800 and thus installed as a preassembled unit in the assembly in the injector body 10 of the fuel injector, which facilitates the assembly.

The foregoing relates to the preferred exemplary embodiments of the invention, it being understood that other variants and embodiments thereof are possible within the spirit and scope of the invention, the latter being defined by the appended claims.

The invention claimed is:

1. A fuel injector having an injector body, a valve body, and a nozzle body in which a needle-shaped injection valve member is disposed longitudinally movably, which member, as a function of the pressure relief or pressure imposition of a control chamber, opens or closes at least one injection opening that discharges into a combustion chamber of an internal combustion engine, and having a valve including a spherically embodied valve element, for pressure relief of the control chamber by attraction of an armature unit to a magnet when electric current flows through the magnet, wherein an axis of the armature unit has an offset relative to an axis of symmetry of the needle-shaped injection valve member, and wherein a part of the armature unit is guided in a bore of the magnet.

2. The fuel injector as defined by claim 1, wherein the armature unit has an inner armature part and an outer armature part, which are joined to one another by positive or material engagement.

3. The fuel injector as defined by claim 1, wherein the armature unit is embodied in one piece.

* * * * *

UNITED STATES PATENT AND TRADEMARK OFFICE

CERTIFICATE OF CORRECTION

PATENT NO. : 8,413,637 B2
APPLICATION NO. : 12/744819
DATED : April 9, 2013
INVENTOR(S) : Matthias Schnell It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 346 days.

Signed and Sealed this
Eleventh Day of June, 2013

Teresa Stanek Rea
*Acting Director of the United States Patent and Trademark Office*